United States Patent [19]

Roche

[11] 4,096,553

[45] Jun. 20, 1978

[54] EMERGENCY TABLE LAMP

[76] Inventor: Thomas F. Roche, 21 W. Main St., Merrimac, Mass. 01860

[21] Appl. No.: 723,045

[22] Filed: Sep. 13, 1976

[51] Int. Cl.[2] ..... F21L 11/00

[52] U.S. Cl. ..... 362/183

[58] Field of Search ..... 240/81 R, 81 BS, 81 H, 240/81 P, 10.6 CH, 1 R

[56] References Cited

U.S. PATENT DOCUMENTS

| | | | |
|---|---|---|---|
| 2,369,288 | 2/1945 | Embury | 240/1 R |
| 2,668,228 | 2/1954 | Levinson et al. | 240/81 R X |
| 3,976,986 | 8/1976 | Zabroski | 240/10.6 CH |

FOREIGN PATENT DOCUMENTS

| | | | |
|---|---|---|---|
| 939,811 | 11/1948 | France | 240/10.6 CH |

*Primary Examiner*—Richard L. Moses
*Attorney, Agent, or Firm*—Weingarten, Maxham & Schurgin

[57] ABSTRACT

An emergency table lamp which functions as an ordinary table lamp during non-emergency conditions and which provides emergency illumination upon loss of A/C power. The emergency table lamp is constructed so as to be aesthetically appealing while still allowing access to the emergency lighting electronics. A battery and charger assembly having spring terminals are held in place within the lamp body and electronically connected by means of an insulating contact plate secured within the lamp body and having appropriate bus bars for providing the required electrical connection. The contact plate allows independent removal of the battery and charger assembly for repair or replacement.

5 Claims, 7 Drawing Figures

EMERGENCY TABLE LAMP

FIELD OF THE INVENTION

This invention relates to a source of emergency lighting and in particular to a highly reliable emergency lighting unit which is suitable both functionally and aesthetically for routine use as a table lamp during non-emergency conditions.

BACKGROUND OF THE INVENTION

It is frequently desirable and often mandatory to provide emergency lighting units as sources of limited but useful illumination upon the loss of AC power for any reason. Such units are particularly imperative in areas such as theaters, hallways, and windowless rooms which are totally dependent on artificial lighting for useful illumination. Emergency lighting units typically contain a battery as a source of electrical energy, a low voltage lamp for providing the emergency illumination, sensing means for detecting the loss of AC power, and a switch for instantaneously connecting the battery to the low voltage lamp to provide illumination upon loss of power. In most instances, a rechargeable wet battery is used as the emergency power source, with means to maintain a full charge whenever normal AC power is available. Two exemplary emergency lighting units are shown in U.S. Pat. Nos. 1,922,079 and 3,294,977.

One of the principal disadvantages of most emergency lighting units known to the prior art is that these units are distinct and separate accessories which are located within the area to be protected without any other function. The wall-hung boxes with projecting sealed-beam bulbs seen in theaters and restaurants are perhaps the most common illustrations of units which cannot be successfully integrated into the functional and decorative arrangements of the premises to be protected but, rather, have the appearance of being afterthoughts. Furthermore, the fact that such units are not functionally integrated with the remainder of the room means that separate wiring facilities must frequently be provided for supplying power, and their positions on walls or partitions often require the use of unsightly goosenecks or similar contrivances to direct the emergency illumination to the required area. For these reasons and others, emergency light sources have not been used in many areas such as rooms in homes and hospitals which should be protected by an emergency lighting system to avoid dangerous conditions arising from a sudden loss of illumination upon failure of the AC power system.

The concept of emergency lighting in the configuration of a table lamp is not in itself new; see, for example, the present applicant's U.S. Design Patent D-212,443. This patent shows a table lamp having customary light bulbs powered, in normal operation by the AC line. Upon power failure, a much smaller bulb is lighted from a battery to provide an acceptable level of emergency illumination.

While such lighting units have been proposed, they have not been either widely available or in common use. Emergency lighting must be extremely reliable to gain acceptance; on the other hand, for a table unit it is absolutely essential that reliability be achieved with minimum cost and with a mechanical structure that permits ease of service with an overall aesthetic appearance.

SUMMARY OF THE INVENTION

The present invention contemplates and has as a primary object the provision of an emergency lighting unit which is similar in outward appearance to a quality table lamp and is usable as such in the ordinary manner under non-emergency conditions. The lamp cord of the unit is plugged into a wall socket to provide power for use under normal conditions and for continuously charging a storage battery contained therein to provide power during emergency conditions. Loss of the AC power for any reason activates the emergency lighting system to provide a lower but reasonable level of illumination for a significant time as determined by the storage capacity of the rechargeable battery. The system may be tested by simply removing the line cord from the wall socket to verify proper operation of the emergency light bulb, thus obviating the necessity of a test switch.

The emergency table lamp of the present invention includes a lamp body which supports the normal and emergency bulbs and which completely encloses the rechargeable battery and a separately housed charging and control unit. The body section may be formed as an inexpensive extrusion, and the entire lamp may be quickly and easily assembled for economy of manufacture, as described in greater detail below. The battery which provides power for emergency illumination and the charging and control unit are of comparable size and shape and each is mechanically retained within the lamp in a manner which permits easy removal for testing or for replacement thereof. The electrical connections required between the removable battery and charger and control unit are provided in a fixed insulation plate which also serves to divide the unit into the spaces needed for both. The body extrusion, together with a base and cap, are formed with means for retaining the necessary wiring without limiting the removability of either battery or control unit.

DETAILED DESCRIPTION OF THE PREFERRED EMBODIMENT

Figure 1:
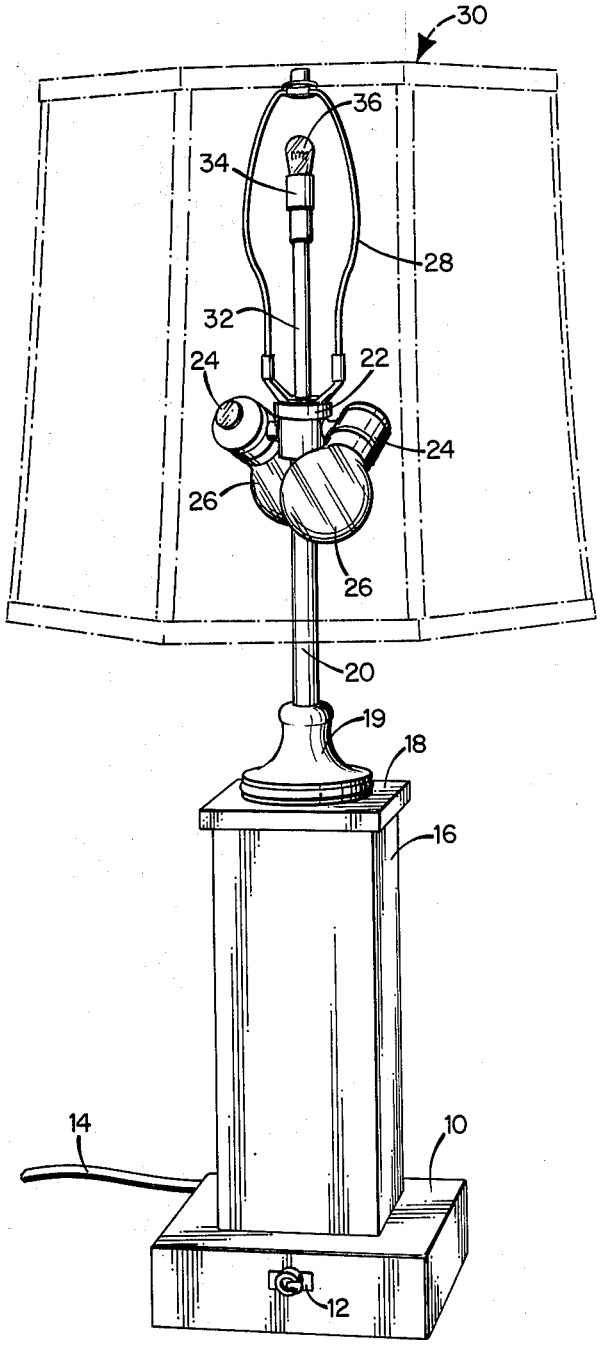
FIG. 1 is a general pictorial view of the novel table lamp providing normal and emergency lighting.

The following is a description of a preferred embodiment of the novel emergency table lamp of the present invention which accomplishes the above-stated objectives of providing both normal and emergency lighting systems which may be plugged into an ordinary wall socket and which serves aesthetically as a high quality table lamp during non-emergency conditions. As shown in FIG. 1, the emergency lamp comprises a base 10 having a conventional ON-OFF switch 12 for turning on and off the normal AC power light bulbs as in a conventional table lamp. AC power is applied to the emergency lamp via an electrical cord 14 which enters the emergency lamp through the rear face of base 10 and which has the usual three-wire grounded plug (not shown) for connection to a wall socket.

Supported upon base 10 is a vertical, hollow, generally square lamp body 16, which contains most of the electrical components and circuits required for emergency operation of the lamp, as explained in greater detail below. Lamp body 16 is terminated by a top cap 18. From top cap 18, a hollow, metal tube or riser 20 projects upwardly. A decorative bezel 19 is typically placed over the connection between riser 20 and top cap 18.

An adapter 22 attached to riser 20, as shown, supports electrical lamp sockets 24 suitable for use with conventional 110 volt light bulbs 26, although the present invention may be implemented using a greater or lesser number of bulbs and sockets depending on the desired level of normal illumination. Adapter 22 supports harp 28 for supporting a lampshade of aesthetic design (as shown by the dotted line 30) in the conventional manner. A second riser 32 extends upwardly from adapter 22 to support a low voltage lamp socket 34 into which is inserted a low voltage bulb 36 suitable for providing emergency illumination for a selected period of time when powered by a storage battery, as described below.

As can be seen from the above description, the emergency lamp shown in FIG. 1 provides a lamp which functions both physically and aesthetically as a normal table lamp during non-emergency conditions. Upon the detection of a loss of line voltage by the circuitry contained within lamp body 16, power is applied to low voltage light bulb 36, providing limited emergency illumination throughout the area in which the lamp is located.

Figure 2:
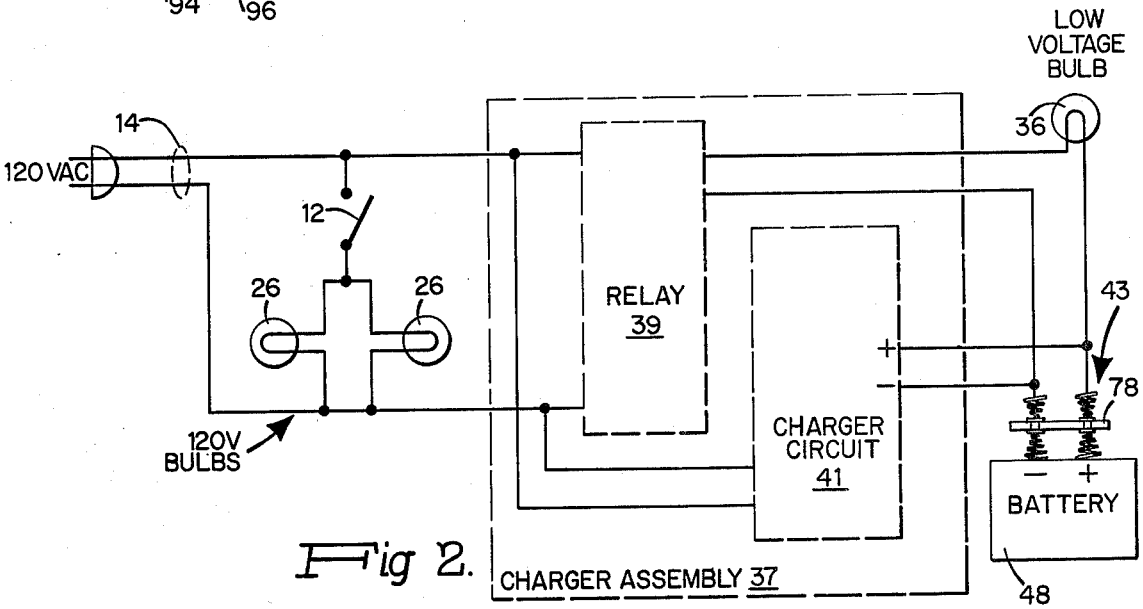
FIG. 2 is a schematic block diagram of an electrical circuit showing interconnection of the various components of the lamp.

The electrical interconnection of the circuitry required to perform the above-described functions may be implemented in any of many forms well known to those in the art. FIG. 2 shows one such implementation suitable for use with the present invention. Line voltage is supplied to the emergency lamp via cord 14, as described above. The 110 volt sockets 24 and bulbs 26 are connected in parallel across the line voltage and may be turned on and off by switch 12 allowing the emergency lamp to be used as a normal table lamp. Line voltage is also supplied to charger assembly 37. Within charger assembly 37 are relay 39 and charger circuit 41, to both of which is applied the line voltage. The output from charger circuit 41 is applied via a contact assembly 43, described in greater detail below, to a battery 48 which stores electrical energy for powering low voltage lamp 36.

One terminal of battery 48 is connected to one terminal of low voltage lamp 36. The other terminal of battery 48 and the remaining terminal of low voltage lamp 36 are connected to the contacts of a relay 39. The AC line voltage from cord 14 is applied to relay 39, and relay 39 is operative to complete the circuit between battery 48 and DC lamp 36 upon the absence of line voltage across the conductors of cord 14. Accordingly, with cord 14 plugged into a wall socket, when AC power is present, charger circuit 41 charges battery 48, DC lamp 36 is off, and AC lamps 26 operate as in a conventional table lamp. Upon the loss of AC power, relay 39 completes the circuit between battery 48 and DC lamp 36, thus providing emergency illumination until AC power is restored.

It should be noted that no test switch is necessary. To verify proper operation of the emergency lamp, the line cord 14 is removed from the wall socket into which it is plugged. This obviates the necessity of having a separate test switch, thus simplifying assembly of the lamp and adding to its appearance as an ordinary table lamp.

Figure 3:
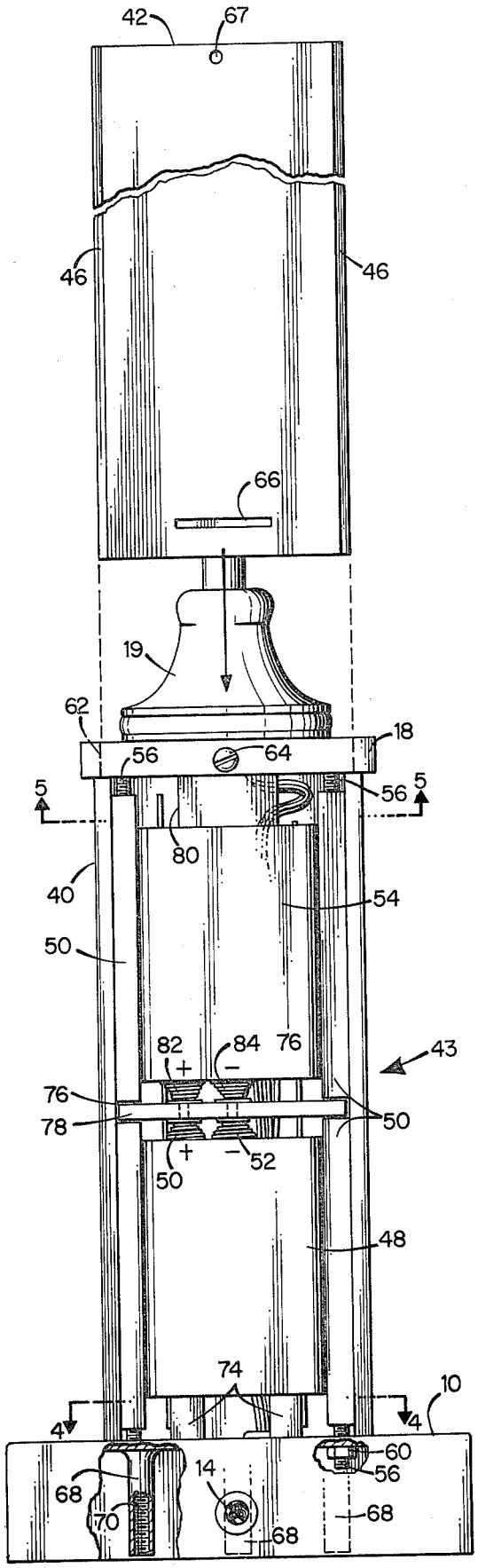
FIG. 3 is a side view, partly in section, of the emergency table lamp with the rear panel shown as withdrawn to reveal the components within the lamp body.

Lamp body 16 is formed from two sections; a three-sided, generally U-shaped channel making up three sides of lamp body 16 and securely retained between lamp base 10 and cap 18, and a slidable, removable access door or plate 42 forming the fourth side of lamp body 16. The relationship of body section 40 and access door 42 may be more clearly seen by referring to FIG. 4 which is a cross-sectional view of lamp body 16, as shown in FIG. 3. Access plate 42 is retained in place by means of lips 44, formed along the edges of body section 40 and bordering the open side thereof, and complementary guide sections 46 along the corresponding edges of access door 42. Access door 42 may thus be slid into place to form the fourth side of lamp body 16.

Lamp body 16 contains within it the circuits necessary for the proper functioning of the emergency light system. In the lower half of the cavity within lamp body 16 is a battery 48 for providing power to low voltage bulb 36 during emergency conditions. Battery 48 is a rechargeable battery and is typically a spill-proof, sealed battery of spring-terminal type. Battery 48 provides power through spring terminals 50 and 52, which are respectively the positive and negative terminals thereof. The top-half of lamp body 16 contains the remainder of the electronics of the emergency light system within a charger housing 54.

Battery 48 and charger assembly housing 54 are rectangularly shaped and are laterally located within lamp body 16 by several ribs running longitudinally along the three sides of lamp body section 40. These ribs 50 are more clearly shown in FIG. 4, and in addition to locating battery 48 and charger housing 54, provide cooling spaces around the battery and charger and provide vertical channels in lamp body 16 for the necessary wiring for the emergency lamp.

Figure 4:
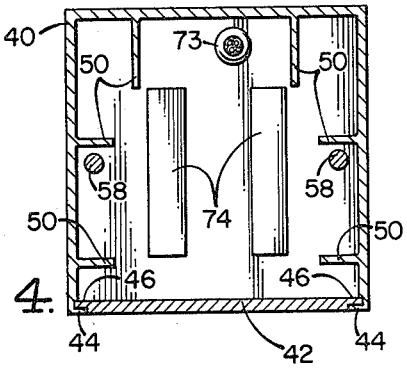
FIG. 4 is a sectional view through the lamp body taken along the plane 4—4 of FIG. 3 looking down with the battery removed.

As shown in FIGS. 3 and 4, lamp body section 40 and access door 42 are each uniform in cross-section and may be easily manufactured as extrusions. It is desirable that lamp body 16 and door 42 be made of a conductive material such as extruded aluminum which may be grounded for reasons of electrical safety.

Figure 5:
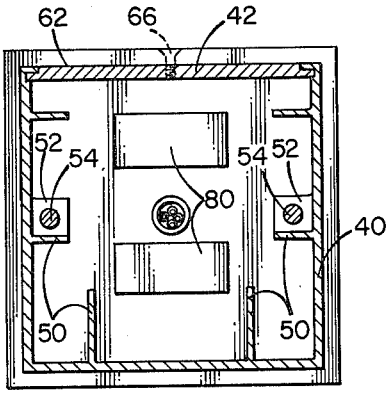
FIG. 5 is a sectional view of the lamp body taken along the plane 5—5 of FIG. 3 looking up with the charger assembly removed.

Lamp body section 40 is held in place between cap 18 and lamp base 10. Cap 18 has two bosses 52 protruding therefrom. This is more clearly shown in FIG. 5 which is a cross-sectional view of lamp housing 16 and cap 18 looking upward, as indicated in FIG. 2. Each boss 52 has a threaded hole 54 formed therein. The bosses 52 are located so that cap 18 may be correctly positioned with respect to body section 40 by engaging the bosses 52 with sidewalls of body section 40 and two of the longitudinal ribs 50, as shown.

Figure 6:
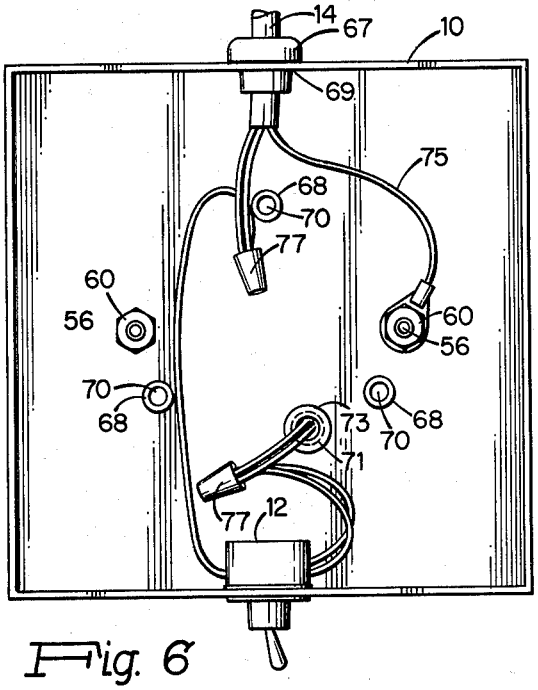
FIG. 6 is a bottom view of the emergency table lamp.

Lamp base 10, lamp body section 40, and cap 18 are held together by means of two long threaded rods 56. These rods are threaded into threaded holes 54 of the bosses 52 in cap 18 and extend down through lamp base section 40 through channels between ribs 50. Threaded rods 56 extend down through the top surface of base 10 through holes 58 and are secured there by nuts 60 threaded onto rods 56. This may be more clearly seen in FIG. 6 which is a bottom view of base 10 with the lamp assembled.

Access door 42 is inserted through a slot 62 formed in cap 18. Access door 42 is then slid into place to form the fourth side of lamp base 16. Access door 42 may be held in place once it has been properly inserted by means of a set screw 64 through hole 66 in cap 18 and a corresponding hole 67 in access door 42. Preferably, access door 42 is of a height such that when in place, the top edge of access door 42 is exactly flush with the upper surface of top cap 18 to preserve the aesthetic appearance of the emergency lamp. Accordingly, a slot 66 may be formed in access door 42 into which a coin or other object may be inserted for raising access door 42.

Referring again to FIG. 6, line cord 14 enters base 10 through a plastic thimble 67 held in place in a hole 69 in base 10. Preferably, a three-wire grounded line cord is used, and the ground conductor 75 may be conveniently attached to the lamp by one of the threaded rods 56 and nuts 60. The power conductors are connected to switch 12 and the emergency lamp electronics in accordance with the circuit diagram in FIG. 2 via conventional techniques, such as wire nuts 77. Wiring passes through hole 71 in base 10 and protective sleeve 73 to the emergency light electronics in lamp body 16 and to AC sockets 24.

Additionally, base 10 may advantageously have one or more bosses 68 formed therein containing threaded holes 70. In this manner, the emergency lamp may be securely fastened to a surface by bolting lamp base 10 to the surface with bolts inserted into threaded holes 70. This may be desirable for several reasons. First, this provides some measure of protection against theft of the emergency lamp. Securing the emergency lamp is also desirable when the lamp is used to provide emergency illumination on ships to prevent the lamp from being tipped over by rough weather or other conditions.

Battery 48 and charger housing 54 are vertically positioned within lamp body 16 in the following manner. Battery 48 rests upon two spacer blocks 74 affixed to lamp base 10. Spacer blocks 74 position battery 48 and also allow a person to put his fingers under battery 48 to remove or insert it. A horizontal slot 76 is milled or otherwise formed in the longitudinal ribs 50 running vertically within lamp body 16. A contact plate 78 is located with slot 76 and extends across substantially the entire interior cross-section of lamp body 16. Spring terminals 50 and 52 of battery 48 allow battery 48 to be inserted in lamp body 16 in the position shown, spring terminals 50 and 52 providing vertical pressure holding battery 48 in the proper position.

Charger housing 54 is similarly held in the top part of lamp body 16. Upper spacer blocks 80 are provided extending downwardly from cap 18 and provide for positioning and removal of the charger housing 54. These spacer blocks 80 may be integrally formed with cap 80 as shown. Charger housing 54 has corresponding spring terminals 82 and 84 projecting downwardly therefrom and of the proper polarity to charge battery 48. Similarly to battery 48, these spring terminals 82 and 84 allow charger housing 54 to be inserted within lamp body 16, and provide sufficient vertical force to hold charger assembly 54 firmly against lateral movement.

Figure 7:
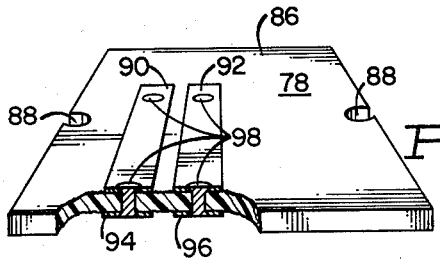
FIG. 7 shows the contact plate which electrically connects and physically locates and separates the emergency lamp battery and charger assembly.

Referring to FIG. 7, the construction of contact plate 78 is shown in more detail. Contact plate 78 is formed from a rectangular piece of insulating material 86 of the proper size to fit within slot 76 in lamp body section 40. Holes 88 are formed in contact plate 78 to allow threaded rods 56 to pass therethrough. Two conductive bus bars 90 and 92 are located on the top surface of contact plate 78 and two additional conductive bus bars 94 and 96 are located directly beneath strips 90 and 92 on the lower surface of contact plate 78. Bus bars 90 and 94 and 92 and 96 are fastened to contact plate 78 and electrically connected by means of rivets 98. Rivets 98 are recessed in contact strips to prevent the edges from catching the spring terminals of charger housing 54 or battery 48 when either is inserted. As shown, plate 78 divides the lamp body into upper and lower chambers for the charger assembly and the rechargeable battery respectively. Each of the latter may be independently removed for service or replacement without disturbing the other.

The battery may be removed without disturbing any of the wiring; on the other hand the charger assembly requires that some wiring be disconnected therefrom. In any event, the independence of these two elements greatly facilitates repair or replacement as required.

Having described the mechanical and electrical details of the novel emergency table lamp, it will be readily apparent that this unit has wide application in industrial, marine and home environments. This lamp may be manufactured economically and may be serviced at minimal cost. Modifications to the present invention will occur to those of ordinary skill in the art in applying the teachings of the present invention to different applications. Accordingly, the present invention is to be construed as limited solely by the appended claims.

What is claimed is:

1. An emergency table lamp comprising:

a hollow, elongate lamp body;

at least one AC line voltage socket for holding a line voltage bulb;

at least one low voltage socket for holding a low voltage bulb;

an independently-removable, rechargeable battery having a pair of spring terminals on one end thereof;

an independently-removable charger assembly within a housing having a pair of spring terminals on one end thereof;

means for applying line voltage to said AC socket and to said charger assembly;

an insulating contact plate having a first pair of electrically conductive buses on the upper surface thereof and a corresponding second pair of electrically conductive buses on the lower surface thereof located directly beneath said first pair of buses, each of said first pair of buses being electrically connected to a respective one of said second pair of buses;

means for securing said contact plate within the lamp body for dividing the interior thereof into upper and lower compartments;

the charger assembly and the battery being located in said upper and lower compartments so that the spring terminals of each are compressed and in contact with the buses of said contact plate to provide electrical interconnection between respective terminals of the charger assembly and battery, and to hold the charger assembly and battery in place by means of the forces exerted by said spring terminals;

means in said charger assembly operative in response to AC line voltage to provide a current to the charger assembly terminals for charging the battery through said buses; and means in said charger assembly operative in response to a loss of AC line voltage to the charger assembly for connecting said battery terminals through said buses to the low voltage bulb.

2. An emergency table lamp comprising:

at least one AC line voltage socket for holding a line voltage bulb;

at least one low voltage socket for holding a low voltage bulb;

a hollow elongate lamp body, including:

a base;

a cap;

said upright, elongate body being disposed intermediate said base and cap and composed of two sections, the first body section being of rectangular cross-section and having three sides and being open on the fourth side and at its upper and lower ends, the second body section forming the fourth side and being slidably insertable to close the open side of the first body section;

the cap being formed so as to allow the second section to be slidably inserted into the first section with the cap in place;

means for retaining the body between the base and the cap; and means for positioning the AC and low voltage lamp sockets above the cap and for holding a lampshade in conjunction therewith so as to conceal said sockets from direct view;

an independently-removable, rechargeable battery having a pair of spring terminals on one end thereof;

an independently-removable charger assembly within a housing having a pair of spring terminals on one end thereof;

means for applying line voltage to said AC socket and to said charger assembly;

an insulating contact plate having a first pair of electrically conductive buses on the upper surface thereof and a corresponding second pair of electrically conductive buses on the lower surface thereof located directly beneath said first pair of buses, each of said first pair of buses being electrically connected to a respective one of said second pair of buses;

means for securing said contact plate within the lamp body for dividing the interior thereof into upper and lower compartments;

the charger assembly and the battery being located in said upper and lower compartments with the terminals of each in contact with the buses of said contact plate;

means in said charger assembly operative in response to AC line voltage to provide a current to the charger assembly terminals for charging the battery through said buses; and means in said charger assembly operative in response to a loss of AC line voltage to the charger assembly for connecting said battery terminals through said buses to the low voltage bulb.

3. The lamp assembly of claim 2 wherein said first body section has at least one vertical rib integrally formed with each of the three sides thereof and extending into the interior of said lamp body for locating said battery and said charger assembly within said lamp body and for providing spaces for cooling, ventilation and wiring.

4. The lamp assembly of claim 3 wherein said cap has at least two threaded holes formed in the lower side thereof;

wherein said base includes corresponding holes located directly beneath said threaded holes in said cap; and wherein said retaining means includes:

at least two rods, the upper end being threaded and screwed into the threaded holes in said cap, the lower ends thereof extending through said corresponding holes in said base; and means for securing said rods in said base to clamp said first body section between said base and said cap.

5. In an emergency table lamp of the type including:

a hollow, elongate lamp body;

at least one low voltage socket for holding a low voltage bulb;

at least one AC line voltage socket for holding a line voltage bulb;

an independently-removable, rechargeable battery having a pair of spring terminals on one end thereof; and an independently-removable charger assembly, including: a housing having a pair of spring terminals on one end thereof; means operative in response to AC line voltage to provide a current to the charger assembly terminals for charging the battery; and means operative in response to a loss of AC line voltage for applying voltage from said battery to the low voltage socket and bulb;

the improvement comprising:

an insulating contact plate having a first pair of electrically conductive buses on the upper surface thereof and a corresponding second pair of electrically conductive buses on the lower surface thereof located directly beneath said first pair of buses, each of said first pair of buses being electrically connected to a respective one of said second pair of buses;

means for securing said contact plate within the lamp body for dividing the interior thereof into two compartments;

the charger assembly and battery being located, one in each of said compartments, so that the spring terminals of each are compressed and in contact with the buses of said contact plate to provide electrical interconnection between the charger assembly and battery and to provide forces for retaining the cahrger assembly and battery in position within the respective compartments;

said charger assembly being operative in response to AC line voltage to provide a current to the charger assembly terminals for charging the battery through said buses; and said charger assembly being further operative in response to a loss of AC line voltage for connecting said battery terminals through said buses to the low voltage socket and bulb.

* * * * *